US009587443B2

(12) United States Patent
Wiercigroch

(10) Patent No.: US 9,587,443 B2
(45) Date of Patent: Mar. 7, 2017

(54) RESONANCE ENHANCED ROTARY DRILLING MODULE

(75) Inventor: Marian Wiercigroch, Aberdeen (GB)

(73) Assignee: ITI SCOTLAND LIMITED, Glasgow (GB)

( * ) Notice: Subject to any disclaimer, the term of this patent is extended or adjusted under 35 U.S.C. 154(b) by 727 days.

(21) Appl. No.: 13/992,199

(22) PCT Filed: Dec. 1, 2011

(86) PCT No.: PCT/EP2011/071550
§ 371 (c)(1),
(2), (4) Date: Dec. 6, 2013

(87) PCT Pub. No.: WO2012/076401
PCT Pub. Date: Jun. 14, 2012

(65) Prior Publication Data

US 2014/0116777 A1 May 1, 2014

(30) Foreign Application Priority Data

Dec. 7, 2010 (GB) ..... 1020660.5
Feb. 14, 2011 (GB) ..... 1102558.2

(51) Int. Cl.
*E21B 7/24* (2006.01)
*E21B 17/07* (2006.01)
(Continued)

(52) U.S. Cl.
CPC ..... *E21B 17/07* (2013.01); *E21B 3/04* (2013.01); *E21B 7/24* (2013.01); *E21B 44/00* (2013.01)

(58) Field of Classification Search
CPC . E21B 17/07; E21B 44/00; E21B 3/04; E21B 7/24; E21B 1/02; E21B 6/00; E21B 6/02; E21B 6/04
See application file for complete search history.

(56) References Cited

U.S. PATENT DOCUMENTS 3,139,146 A * 6/1964 Bodine, Jr. ..... E21B 7/24 175/107
3,768,576 A 10/1973 Martini
(Continued)

FOREIGN PATENT DOCUMENTS

GB 2328342 A 2/1999
GB 2473619 A1 3/2011
(Continued)

OTHER PUBLICATIONS

Dantinne, Patrick; International Search Report; Date of Mailing: Sep. 17, 2012; International Application No: PCT/EP2011/07155; 5 pages.

(Continued)

*Primary Examiner* — Brad Harcourt
(74) *Attorney, Agent, or Firm* — Gavrilovich, Dodd & Lindsey LLP

(57) ABSTRACT

Provided is apparatus for use in resonance enhanced rotary drilling, which apparatus comprises:
(i) an upper load-cell for measuring static and dynamic axial loading;
(ii) a vibration isolation unit;
(iii) optionally an oscillator back mass;
(iv) an oscillator for applying axial oscillatory loading to the rotary drill-bit;
(v) a vibration transmission unit;
(vi) a lower load-cell for measuring static and dynamic axial loading;
(vii) a drill-bit connector; and
(viii) a drill-bit,
wherein the upper load-cell is positioned above the vibration isolation unit and the lower load-cell is positioned between the vibration transmission unit and the drill-bit, and wherein the upper and lower load-cells are connected to a controller in order to provide down-hole closed loop real time control of the oscillator.

(Continued)

Further provided is an apparatus for use in resonance enhanced rotary drilling, which apparatus comprises:

(i) an upper load-cell for measuring static loading;
(ii) a vibration isolation unit;
(iii) an oscillator for applying axial oscillatory loading to the rotary drill-bit;
(iv) a lower load-cell for measuring dynamic axial loading;
(v) a drill-bit connector; and
(vi) a drill-bit, wherein the upper load-cell positioned above the vibration isolation unit and the lower load-cell is positioned between the oscillator and the drill-bit wherein the upper and lower load-cells are connected to a controller in order to provide down-hole closed loop real time control of the oscillator.

23 Claims, 6 Drawing Sheets

(51) Int. Cl.
*E21B 3/04* (2006.01)
*E21B 44/00* (2006.01)

(56) References Cited

U.S. PATENT DOCUMENTS

| | | | | |
|---|---|---|---|---|
| 4,276,947 | A | 7/1981 | Hebel | |
| 2006/0157280 | A1 | 7/2006 | Fincher et al. | |
| 2007/0221408 | A1* | 9/2007 | Hall | E21B 4/06 175/57 |
| 2011/0280104 | A1* | 11/2011 | McClung, III | E21B 3/02 367/82 |

FOREIGN PATENT DOCUMENTS

| | | | |
|---|---|---|---|
| WO | 2007/141550 | A1 | 12/2007 |
| WO | 2007141550 | A1 | 12/2007 |

OTHER PUBLICATIONS

Ellis, Lyndon, Search Report, European Patent Office, GB1102558.2, Feb. 1, 2012.

* cited by examiner

RESONANCE ENHANCED ROTARY DRILLING MODULE

CROSS REFERENCE TO RELATED APPLICATIONS

This application is a National Stage Application filed under 35 U.S.C. §371 and claims priority to International Application Serial No. PCT/EP2011/071550, filed Dec. 1, 2011, which application claims priority to Great Britain Application Nos. 1020660.5, filed Dec. 7, 2010, and 1102558.2, filed Feb. 14, 2011, the disclosures of which are incorporated herein by reference.

The present invention relates to high frequency percussion enhanced rotary drilling, and in particular to resonance enhanced drilling. Embodiments of the invention are directed to apparatus and methods for resonance enhanced rotary drilling to improve drilling performance. Further embodiments of this invention are directed to resonance enhanced drilling equipment which may be controllable according to these methods and apparatus. Certain embodiments of the invention are applicable to any size of drill or material to be drilled. Certain more specific embodiments are directed at drilling through rock formations, particularly those of variable composition, which may be encountered in deep-hole drilling applications in the oil, gas mining and construction industries.

Percussion enhanced rotary drilling is known per se. A percussion enhanced rotary drill comprises a rotary drill-bit and an oscillator for applying oscillatory loading to the rotary drill-bit. The oscillator provides impact forces on the material being drilled so as to break up the material which aids the rotary drill-bit in cutting though the material.

Resonance enhanced rotary drilling is a special type of percussion enhanced rotary drilling in which the oscillator is vibrated at high frequency so as to achieve resonance with the material being drilled. This results in an amplification of the pressure exerted at the rotary drill-bit thus increasing drilling efficiency when compared to standard percussion enhanced rotary drilling.

U.S. Pat. No. 3,990,522 discloses a percussion enhanced rotary drill which uses a hydraulic hammer mounted in a rotary drill for drilling bolt holes. It is disclosed that an impacting cycle of variable stroke and frequency can be applied and adjusted to the natural frequency of the material being drilled to produce an amplification of the pressure exerted at the tip of the drill-bit. A servovalve maintains percussion control, and in turn, is controlled by an operator through an electronic control module connected to the servovalve by an electric conductor. The operator can selectively vary the percussion frequency from 0 to 2500 cycles per minute (i.e. 0 to 42 Hz) and selectively vary the stroke of the drill-bit from 0 to ⅛ inch (i.e. 0 to 3.175 mm) by controlling the flow of pressurized fluid to and from an actuator. It is described that by selecting a percussion stroke having a frequency that is equal to the natural or resonant frequency of the rock strata being drilled, the energy stored in the rock strata by the percussion forces will result in amplification of the pressure exerted at the tip of the drill-bit such that the solid material will collapse and dislodge and permit drill rates in the range 3 to 4 feet per minute.

There are several problems which have been identified with the aforementioned arrangement and which are discussed below.

High frequencies are not attainable using the apparatus of U.S. Pat. No. 3,990,522 which uses a relatively low frequency hydraulic oscillator. Accordingly, although U.S. Pat. No. 3,990,522 discusses the possibility of resonance, it would appear that the low frequencies attainable by its oscillator are insufficient to achieve resonance enhanced drilling through many hard materials.

Regardless of the frequency issue discussed above, resonance cannot easily be achieved and maintained in any case using the arrangement of U.S. Pat. No. 3,990,522, particularly if the drill passes through different materials having different resonance characteristics. This is because control of the percussive frequency and stroke in the arrangement of U.S. Pat. No. 3,990,522 is achieved manually by an operator. As such, it is difficult to control the apparatus to continuously adjust the frequency and stroke of percussion forces to maintain resonance as the drill passes through materials of differing type. This may not be such a major problem for drilling shallow bolt holes as described in U.S. Pat. No. 3,990,522. An operator can merely select a suitable frequency and stroke for the material in which a bolt hole is to be drilled and then operate the drill. However, the problem is exacerbated for deep-drilling through many different layers of rock. An operator located above a deep-drilled hole cannot see what type of rock is being drilled through and cannot readily achieve and maintain resonance as the drill passes from one rock type to another, particularly in regions where the rock type changes frequently.

Some of the aforementioned problems have been solved by the present inventor as described in WO 2007/141550. WO 2007/141550 describes a resonance enhanced rotary drill comprising an automated feedback and control mechanism which can continuously adjust the frequency and stroke of percussion forces to maintain resonance as a drill passes through rocks of differing type. The drill is provided with an adjustment means which is responsive to conditions of the material through which the drill is passing and a control means in a downhole location which includes sensors for taking downhole measurements of material characteristics whereby the apparatus is operable downhole under closed loop real-time control.

US2006/0157280 suggests down-hole closed loop real-time control of an oscillator. It is described that sensors and a control unit can initially sweep a range of frequencies while monitoring a key drilling efficiency parameter such as rate of progression (ROP). An oscillation device can then be controlled to provide oscillations at an optimum frequency until the next frequency sweep is conducted. The pattern of the frequency sweep can be based on a one or more elements of the drilling operation such as a change in formation, a change in measured ROP, a predetermined time period or instruction from the surface. The detailed embodiment utilises an oscillation device which applies torsional oscillation to the rotary drill-bit and torsional resonance is referred to. However, it is further described that exemplary directions of oscillation applied to the drill-bit include oscillations across all degrees-of-freedom and are not utilised in order to initiate cracks in the material to be drilled. Rather, it is described that rotation of the drill-bit causes initial fractioning of the material to be drilled and then a momentary oscillation is applied in order to ensure that the rotary drill-bit remains in contact with the fracturing material. There does not appear to be any disclosure or suggestion of providing an oscillator which can import sufficiently high axial oscillatory loading to the drill-bit in order to initiate cracks in the material through which the rotary drill-bit is passing as is required in accordance with resonance enhanced drilling as described in WO 2007/141550.

None of the prior art provides any detail about how to monitor axial oscillations. Sensors are disclosed generally in the US2006/0157280 and in WO 2007/141550 but the positions of these sensors relative to components such as a vibration isolation unit and a vibration transmission unit is not discussed.

Despite the solutions described in the prior art, there has been a desire to make further improvements to the methods and apparatus it describes. It is an aim of embodiments of the present invention to make such improvements in order to increase drilling efficiency, increase drilling speed and bore-hole stability and quality, while limiting wear and tear on the apparatus so as to increase the lifetime of the apparatus. It is a further aim to more precisely control resonance enhanced drilling, particularly when drilling through rapidly changing rock types.

Accordingly, the present invention provides an apparatus for use in resonance enhanced rotary drilling, which apparatus comprises:

(i) an upper load-cell for measuring static and dynamic axial loading;
(ii) a vibration isolation unit;
(iii) optionally an oscillator back mass;
(iv) an oscillator comprising a dynamic exciter for applying axial oscillatory loading to the rotary drill-bit;
(v) a vibration transmission unit;
(vi) a lower load-cell for measuring static and dynamic axial loading;
(vii) a drill-bit connector; and
(viii) a drill-bit, wherein the upper load-cell is positioned above the vibration isolation unit and the lower load-cell is positioned between the vibration transmission unit and the drill-bit, and wherein the upper and lower load-cells are connected to a controller in order to provide down-hole closed loop real time control of the oscillator.

It is envisaged that this apparatus may be employed as a resonance enhanced drilling module in a drill-string. The drill-string configuration is not especially limited, and any configuration may be envisaged, including known configurations. The module may be turned on or off as and when resonance enhancement is required.

In this apparatus arrangement, the dynamic exciter typically comprises a magnetostrictive exciter. The magnetostrictive exciter is not especially limited, and in particular there is no design restriction on the transducer or method of generating axial excitation. Preferably the exciter comprises a PEX-30 oscillator from Magnetic Components AB.

The dynamic exciter employed in the present arrangement is a magnetostrictive actuator working on the principle that magnetostrictive materials, when magnetised by an external magnetic field, change their inter-atomic separation to minimise total magneto-elastic energy. This results in a relatively large strain. Hence, applying an oscillating magnetic field provides in an oscillatory motion of the magnetostrictive material.

Magnetostrictive materials may be pre-stressed uniaxially so that the atomic moments are pre-aligned perpendicular to the axis. A subsequently applied strong magnetic field parallel to the axis realigns the moments parallel to the field, and this coherent rotation of the magnetic moments leads to strain and elongation of the material parallel to the field. Such magnetostrictive actuators can be obtained from MagComp and Magnetic Components AB. As mentioned above, one particularly preferred actuator is the PEX-30 by Magnetic Components AB.

It is also envisaged that magnetic shape memory materials such as shape memory alloys may be utilized as they can offer much higher force and strains than the most commonly available magnetostrictive materials. Magnetic shape memory materials are not strictly speaking magnetostrictive. However, as they are magnetic field controlled they are to be considered as magnetostrictive actuators for the purposes of the present invention.

In this arrangement, the vibration transmission unit is not especially limited, but preferably comprises a structural spring. It may be, for example, a torroidal unit with a concertina-shaped wall, preferably a hollow metal can with a concertina-shaped wall. The vibration isolation unit is also not especially limited, and may comprise a structural spring. It may be, for example, a torroidal unit with a concertina-shaped wall, preferably a hollow metal can with a concertina-shaped wall.

In this arrangement, the positioning of the upper load-cell is typically such that the static axial loading from the drill string can be measured. The position of the lower load-cell is typically such that dynamic loading passing from the oscillator through the vibration transmission unit to the drill-bit can be measured. The order of the components of the apparatus of this embodiment is particularly preferred to be from (i)-(viii) above from the top down.

In a further embodiment the invention provides an apparatus for use in resonance enhanced rotary drilling, which apparatus comprises:

(i) an upper load-cell for measuring static loading;
(ii) a vibration isolation unit;
(iii) an oscillator for applying axial oscillatory loading to the rotary drill-bit;
(iv) a lower load-cell for measuring dynamic axial loading;
(v) a drill-bit connector; and
(vi) a drill-bit, wherein the upper load-cell positioned above the vibration isolation unit and the lower load-cell is positioned between the oscillator and the drill-bit wherein the upper and lower load-cells are connected to a controller in order to provide down-hole closed loop real time control of the oscillator.

It is envisaged that this apparatus may be employed as a resonance enhanced drilling module in a drill-string. The drill-string configuration is not especially limited, and any configuration may be envisaged, including known configurations. The module may be turned on or off as and when resonance enhancement is required.

In this apparatus arrangement, the oscillator typically comprises an electrically driven mechanical actuator. The mechanical actuator is not especially limited, and preferably comprises a VR2510 actuator from Vibratechniques Ltd.

An electrically driven mechanical actuator can use the concept of two eccentric rotating masses to provide the needed axial vibrations. Such a vibrator module is composed of two eccentric counter-rotating masses as the source of high-frequency vibrations. The displacement provided by this arrangement can be substantial (approximately 2 mm). Suitable mechanical vibrators based on the principle of counter-rotating eccentric masses are available from Vibratechniques Ltd. One possible vibrator for certain embodiments of the present invention is the VR2510 model. This vibrator rotates the eccentric masses at 6000 rpm which corresponds to an equivalent vibration frequency of 100 Hz. The overall weight of the unit is 41 kg and the unit is capable of delivering forces up to 24.5 kN. The power consumption of the unit is 2.2 kW.

This arrangement differs from the arrangement of the first embodiment in that no vibration transmission unit is required to mechanically amplify the vibrations. This is because the mechanical actuator provides sufficient amplitude of vibration itself. Furthermore, as this technique relies on the effect of counter-rotating masses, the heavy back mass used in the magnetostrictive embodiment is not required. The vibration isolation unit is not especially limited, but preferably comprises a structural spring. It may be, for example, a torroidal unit with a concertina-shaped wall, preferably a hollow metal can with a concertina-shaped wall.

In this arrangement, the positioning of the upper load-cell is typically such that the static axial loading from the drill string can be measured. The position of the lower load-cell is typically such that dynamic loading passing from the oscillator to the drill-bit can be monitored. The order of the components of the apparatus of this embodiment is particularly preferred to be from (i)-(vi) above from the top down.

The apparatus of each of the arrangements gives rise to a number of advantages. These include: increased drilling speed; better borehole stability and quality; less stress on apparatus leading to longer lifetimes; and greater efficiency reducing energy costs.

The preferred applications for both embodiments are in large scale drilling apparatus, control equipment and methods of drilling for the oil and gas industry. However, other drilling applications may also benefit, including: surface drilling equipment, control equipment and methods of drilling for road contractors; drilling equipment, control equipment and method of drilling for the mining industry; hand held drilling equipment for home use and the like; specialist drilling, e.g. dentist drills.

The invention will now be described in more detail by way of example only, with reference to the following Figures, in which.

Figure 3:
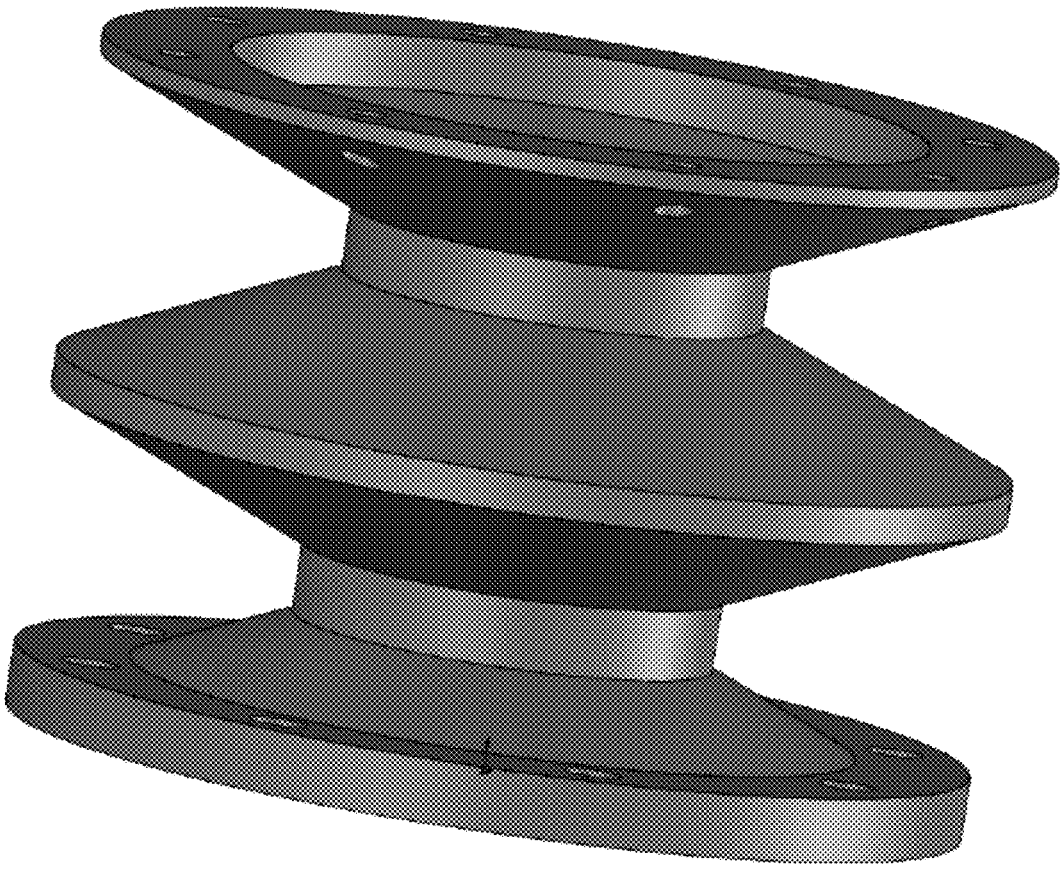
Figure 4:
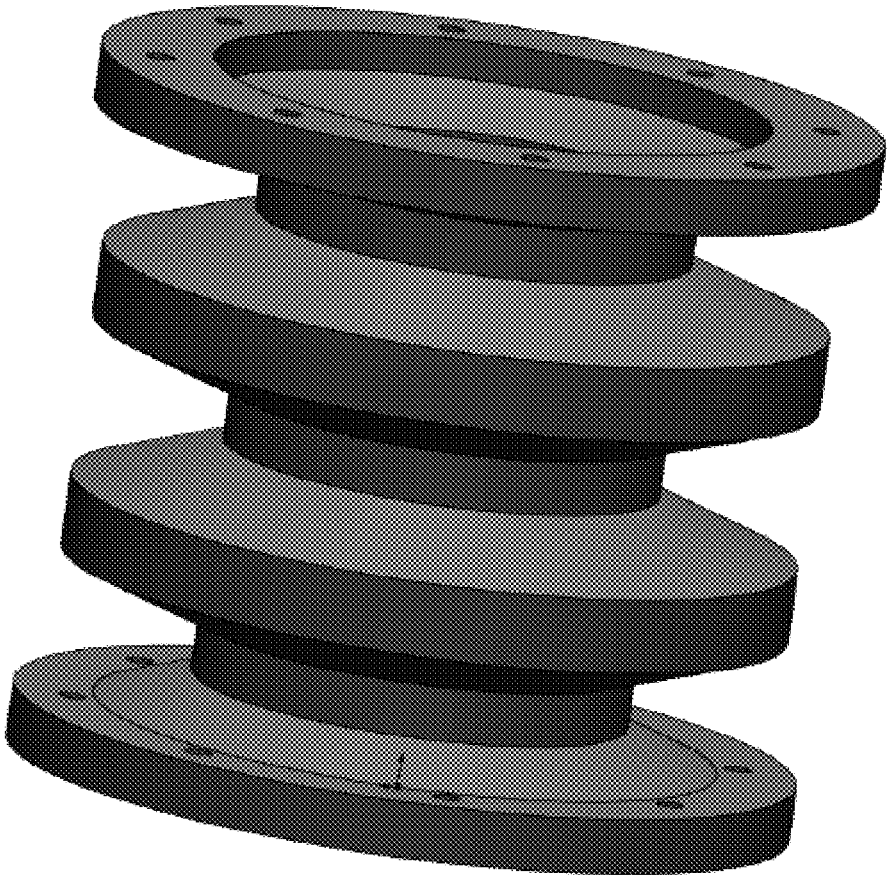
Figure 5:
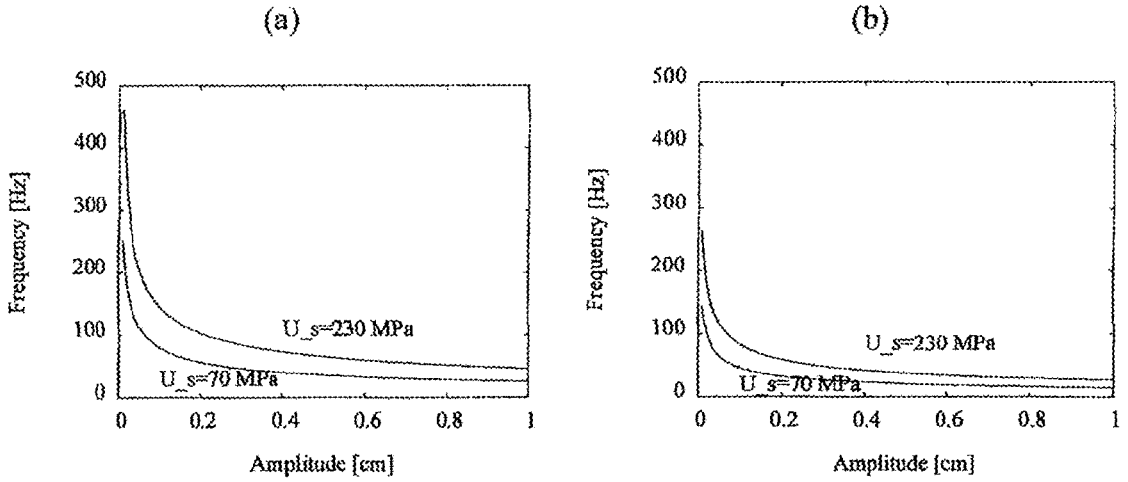
Figure 6:
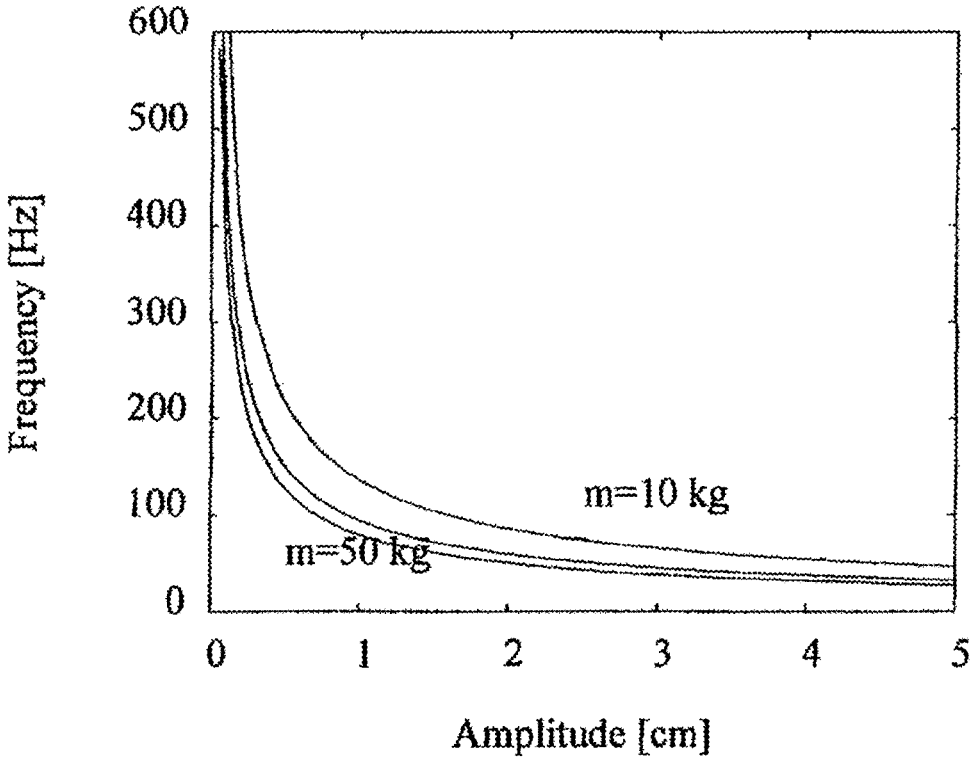
Figure 7:
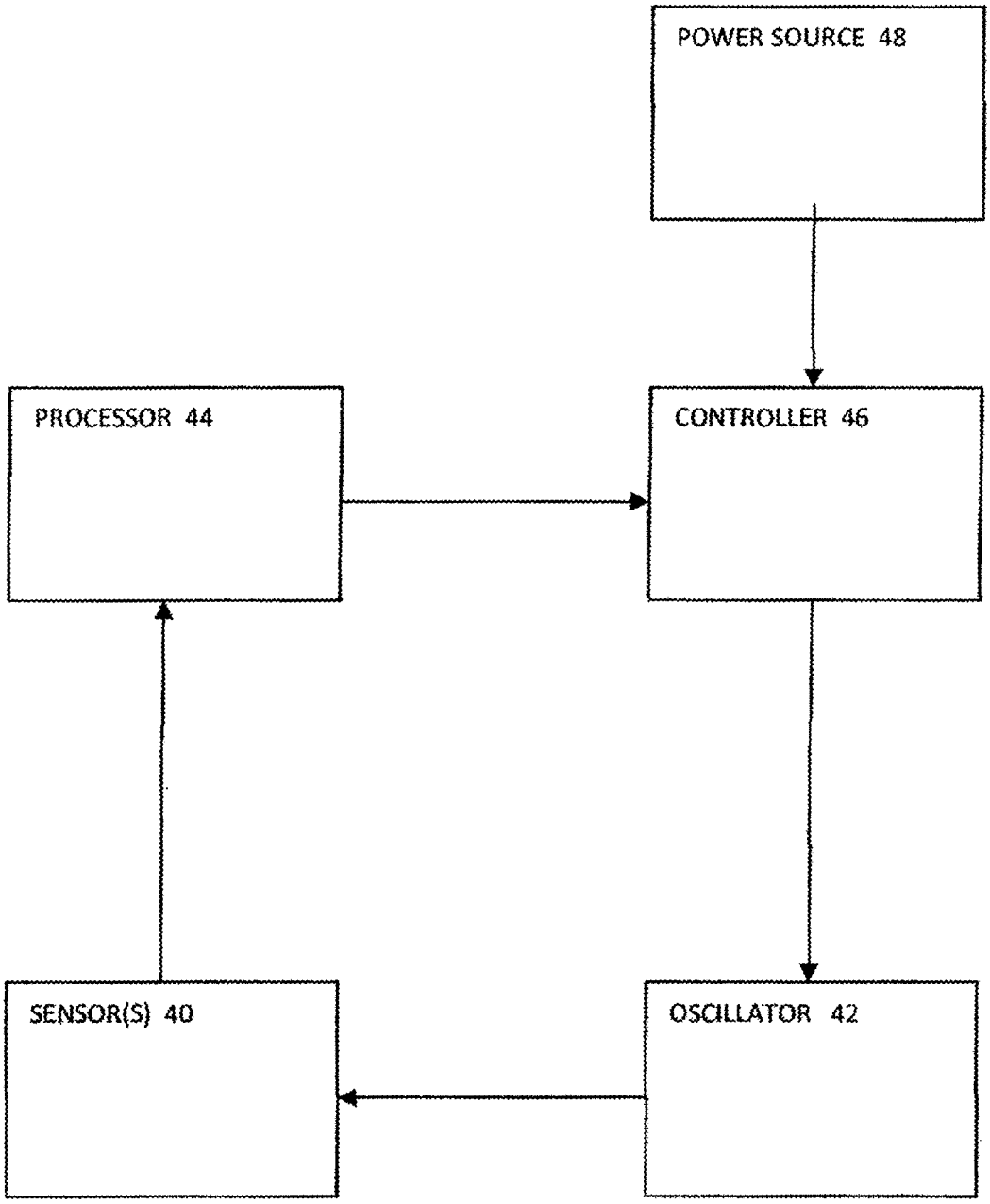

FIG. 3 depicts a schematic of a vibration isolation unit which may be used in the present invention; and FIG. 4 depicts a schematic of a vibration transmission unit which may be used in the present invention; and FIGS. 5(*a*) and (*b*) show graphs illustrating necessary minimum frequency as a function of vibration amplitude for a drill-bit having a diameter of 150 mm; and FIG. 6 shows a graph illustrating maximum applicable frequency as a function of vibration amplitude for various vibrational masses given a fixed power supply; and FIG. 7 shows a schematic diagram illustrating a downhole closed loop real-time feedback mechanism.

It will be apparent that provided that electrical power is supplied downhole, the apparatus of the embodiments (arrangements) of the invention can function autonomously and adjust the rotational and/or oscillatory loading of the drill-bit in response to the current drilling conditions so as to optimize the drilling mechanism.

During a drilling operation, the rotary drill-bit is rotated and an axially oriented dynamic loading is applied to the drill-bit by the oscillator to generate a crack propagation zone to aid the rotary drill-bit in cutting though material.

The oscillator and/or dynamic exciter is controlled in accordance with preferred methods of the present invention. Thus, the invention further provides a method for controlling a resonance enhanced rotary drill comprising an apparatus as defined above, the method comprising:

controlling frequency (f) of the oscillator in the resonance enhanced rotary drill whereby the frequency (f) is maintained in the range:

$$(D^2U_s/(8000\pi Am))^{1/2} \leq f \leq S_f(D^2U_s/(8000\pi Am))^{1/2}$$

where D is diameter of the rotary drill-bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

The ranges for the frequency and dynamic force are based on the following analysis.

The compressive strength of the formation gives a lower bound on the necessary impact forces. The minimum required amplitude of the dynamic force has been calculated as:

$$F_d = \frac{\pi}{4} D^2_{eff} U_s.$$

$D_{eff}$ is an effective diameter of the rotary drill-bit which is the diameter D of the drill-bit scaled according to the fraction of the drill-bit which contacts the material being drilled. Thus, the effective diameter $D_{eff}$ may be defined as:

$$D_{eff} = \sqrt{S_{contact}}D,$$

where $S_{contact}$ is a scaling factor corresponding to the fraction of the drill-bit which contacts the material being drilled. For example, estimating that only 5% of the drill-bit surface is in contact with the material being drilled, an effective diameter $D_{eff}$ can be defined as:

$$D_{eff} = \sqrt{0.05}D.$$

The aforementioned calculations provide a lower bound for the dynamic force of the oscillator. Utilizing a dynamic force greater than this lower bound generates a crack propagation zone in front of the drill-bit during operation. However, if the dynamic force is too large then the crack propagation zone will extend far from the drill-bit compromising borehole stability and reducing borehole quality. In addition, if the dynamic force imparted on the rotary drill by the oscillator is too large then accelerated and catastrophic tool wear and/or failure may result. Accordingly, an upper bound to the dynamic force may be defined as:

$$S_{Fd}[(\pi/4)D^2_{eff}U_s]$$

where $S_{Fd}$ is a scaling factor greater than 1. In practice $S_{Fd}$ is selected according to the material being drilled so as to ensure that the crack propagation zone does not extend too far from the drill-bit compromising borehole stability and reducing borehole quality. Furthermore, $S_{Fd}$ is selected according to the robustness of the components of the rotary drill to withstand the impact forces of the oscillator. For certain applications $S_{Fd}$ will be selected to be less than 5, preferably less than 2, more preferably less than 1.5, and most preferably less than 1.2. Low values of $S_{Fd}$ (e.g. close to 1) will provide a very tight and controlled crack propagation zone and also increase lifetime of the drilling components at the expensive of rate of propagation. As such, low values for $S_{Fd}$ are desirable when a very stable, high quality borehole is required. On the other hand, if rate of propagation is the more important consideration then a higher value for $S_{Fd}$ may be selected.

During impacts of the oscillator of period $\tau$, the velocity of the drill-bit of mass m changes by an amount $\Delta v$, due to the contact force F=F(t):

$$m\Delta v = \int_0^{\tau} F(t)dt,$$

where the contact force F(t) is assumed to be harmonic. The amplitude of force F(t) is advantageously higher than the force $F_d$ needed to break the material being drilled. Hence a lower bound to the change of impulse may be found as follows:

$$m\Delta v = \int_0^{\tau} F_d \sin\left(\frac{\pi t}{\tau}\right)dt = \frac{1}{2}U_s 0.05D^2\tau.$$

Assuming that the drill-bit performs a harmonic motion between impacts, the maximum velocity of the drill-bit is $v_m = A\omega$, where A is the amplitude of the vibration, and $\omega = 2\pi f$ is its angular frequency. Assuming that the impact occurs when the drill-bit has maximum velocity $v_m$, and that the drill-bit stops during the impact, then $\Delta v = v_m = 2A\pi f$. Accordingly, the vibrating mass is expressed as $$m = \frac{0.05D^2U_s\tau}{4\pi fA}.$$

This expression contains $\tau$, the period of the impact. The duration of the impact is determined by many factors, including the material properties of the formation and the tool, the frequency of impacts, and other parameters. For simplicity, $\tau$ is estimated to be 1% of the time period of the vibration, that is, $\tau = 0.01/f$: This leads to a lower estimation of the frequency that can provide enough impulse for the impacts:

$$f = \sqrt{\frac{D^2U_s}{8000\pi Am}}.$$

The necessary minimum frequency is proportional to the inverse square root of the vibration amplitude and the mass of the bit.

The aforementioned calculations provide a lower bound for the frequency of the oscillator. As with the dynamic force parameter, utilizing a frequency greater than this lower bound generates a crack propagation zone in front of the drill-bit during operation. However, if the frequency is too large then the crack propagation zone will extend far from the drill-bit compromising borehole stability and reducing borehole quality. In addition, if the frequency is too large then accelerated and catastrophic tool wear and/or failure may result. Accordingly, an upper bound to the frequency may be defined as:

$$S_f(D^2U_s/(8000\pi Am))^{1/2}$$

where $S_f$ is a scaling factor greater than 1. Similar considerations to those discussed above in relation to $S_{Fd}$ apply to the selection of $S_f$. Thus, for certain applications $S_f$ will be selected to be less than 5, preferably less than 2, more preferably less than 1.5, and most preferably less than 1.2.

In addition to the aforementioned considerations for operational frequency of the oscillator, it is advantageous that the frequency is maintained in a range which approaches, but does not exceed, peak resonance conditions for the material being drilled. That is, the frequency is advantageously high enough to be approaching peak resonance for the drill-bit in contact with the material being drilled while being low enough to ensure that the frequency does not exceed that of the peak resonance conditions which would lead to a dramatic drop off in amplitude. Accordingly, $S_f$ is advantageously selected whereby:

$$f_r/S_r \leq f \leq f_r$$

where $f_r$ is a frequency corresponding to peak resonance conditions for the material being drilled and $S_r$ is a scaling factor greater than 1.

Similar considerations to those discussed above in relation to $S_{Fd}$ and $S_f$ apply to the selection of $S_r$. For certain applications $S_r$ will be selected to be less than 2, preferably less than 1.5, more preferably less than 1.2. High values of $S_r$ allow lower frequencies to be utilized which can result in a smaller crack propagation zone and a lower rate of propagation. Lower values of $S_r$ (i.e. close to 1) will constrain the frequency to a range close to the peak resonance conditions which can result in a larger crack propagation zone and a higher rate of propagation. However, if the crack propagation zone becomes too large then this may compromise borehole stability and reduce borehole quality.

One problem with drilling through materials having varied resonance characteristics is that a change in the resonance characteristics could result in the operational frequency suddenly exceeding the peak resonance conditions which would lead to a dramatic drop off in amplitude. To solve this problem it may be appropriate to select $S_f$ whereby:

$$f \leq (f_r - X)$$

where X is a safety factor ensuring that the frequency (f) does not exceed that of peak resonance conditions at a transition between two different materials being drilled. In such an arrangement, the frequency may be controlled so as to be maintained within a range defined by:

$$f_r/S_r \leq f \leq (f_r - X)$$

where the safety factor X ensures that the frequency is far enough from peak resonance conditions to avoid the operational frequency suddenly exceeding that of the peak resonance conditions on a transition from one material type to another which would lead to a dramatic drop off in amplitude.

Similarly a safety factor may be introduced for the dynamic force. For example, if a large dynamic force is being applied for a material having a large compressive strength and then a transition occurs to a material having a much lower compressive strength, this may lead to the dynamic force suddenly being much too large resulting in the crack propagation zone extend far from the drill-bit compromising borehole stability and reducing borehole quality at material transitions. To solve this problem it may be appropriate to operate within the following dynamic force range:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled. The safety factor Y ensures that the dynamic force is not too high that if a sudden transition occurs to a material which has a low compressive strength then this will not lead to catastrophic extension of the crack propagation zone compromising borehole stability.

The safety factors X and/or Y may be set according to predicted variations in material type and the speed with which the frequency and dynamic force can be changed when a change in material type is detected. That is, one or both of X and Y are preferably adjustable according to predicted variations in the compressive strength ($U_s$) of the material being drilled and speed with which the frequency (f) and dynamic force ($F_d$) can be changed when a change in the compressive strength ($U_s$) of the material being drilled is detected. Typical ranges for X include: $X>f_r/100$; $X>f_r/50$; or $X>f_r/10$. Typical ranges for Y include: $Y>S_{Fd}[(\pi/4)D^2_{eff}U_s]/100$; $Y>S_{Fd}[(\pi/4)D^2_{eff}U_s]/50$; or $Y>S_{Fd}[(\pi/4)D^2_{eff}U_s]/10$.

Embodiments which utilize these safety factors may be seen as a compromise between working at optimal operational conditions for each material of a composite strata structure and providing a smooth transition at interfaces between each layer of material to maintain borehole stability at interfaces.

The previously described embodiments of the present invention are applicable to any size of drill or material to be drilled. Certain more specific embodiments are directed at drilling through rock formations, particularly those of variable composition, which may be encountered in deep-hole drilling applications in the oil, gas and mining industries. The question remains as to what numerical values are suitable for drilling through such rock formations.

The compressive strength of rock formations has a large variation, from around $U_s$=70 MPa for sandstone up to $U_s$=230 MPa for granite. In large scale drilling applications such as in the oil industry, drill-bit diameters range from 90 to 800 mm (3½ to 32"). If only approximately 5% of the drill-bit surface is in contact with the rock formation then the lowest value for required dynamic force is calculated to be approximately 20 kN (using a 90 mm drill-bit through sandstone). Similarly, the largest value for required dynamic force is calculated to be approximately 6000 kN (using an 800 mm drill-bit through granite). As such, for drilling through rock formations the dynamic force is preferably controlled to be maintained within the range 20 to 6000 kN depending on the diameter of the drill-bit. As a large amount of power will be consumed to drive an oscillator with a dynamic force of 6000 kN it may be advantageous to utilize the invention with a mid-to-small diameter drill-bit for many applications. For example, drill-bit diameters of 90 to 400 mm result in an operational range of 20 to 1500 kN. Further narrowing the drill-bit diameter range gives preferred ranges for the dynamic force of 20 to 1000 kN, more preferably 20 to 500 kN, more preferably still 20 to 300 kN.

A lower estimate for the necessary displacement amplitude of vibration is to have a markedly larger vibration than displacements from random small scale tip bounces due to inhomogeneities in the rock formation. As such the amplitude of vibration is advantageously at least 1 mm. Accordingly, the amplitude of vibration of the oscillator may be maintained within the range 1 to 10 mm, more preferably 1 to 5 mm.

For large scale drilling equipment the vibrating mass may be of the order of 10 to 1000 kg. The feasible frequency range for such large scale drilling equipment does not stretch higher than a few hundred Hertz. As such, by selecting suitable values for the drill-bit diameter, vibrating mass and amplitude of vibration within the previously described limits, the frequency (f) of the oscillator can be controlled to be maintained in the range 100 to 500 Hz while providing sufficient dynamic force to create a crack propagation zone for a range of different rock types and being sufficiently high frequency to achieve a resonance effect.

FIGS. 5(*a*) and (*b*) show graphs illustrating necessary minimum frequency as a function of vibration amplitude for a drill-bit having a diameter of 150 mm. Graph (a) is for a vibrational mass m=10 kg whereas graph (b) is for a vibrational mass m=30 kg. The lower curves are valid for weaker rock formations while the upper curves are for rock with high compressive strength. As can be seen from the graphs, an operational frequency of 100 to 500 Hz in the area above the curves will provide a sufficiently high frequency to generate a crack propagation zone in all rock types using a vibrational amplitude in the range 1 to 10 mm (0.1 to 1 cm).

FIG. 6 shows a graph illustrating maximum applicable frequency as a function of vibration amplitude for various vibrational masses given a fixed power supply. The graph is calculated for a power supply of 30 kW which can be generated down hole by a mud motor or turbine used to drive the rotary motion of the drill-bit. The upper curve is for a vibrating mass of 10 kg whereas the lower curve is for a vibrating mass of 50 kg. As can be seen from the graph, the frequency range of 100 to 500 Hz is accessible for a vibrational amplitude in the range 1 to 10 mm (0.1 to 1 cm).

Figure 1:
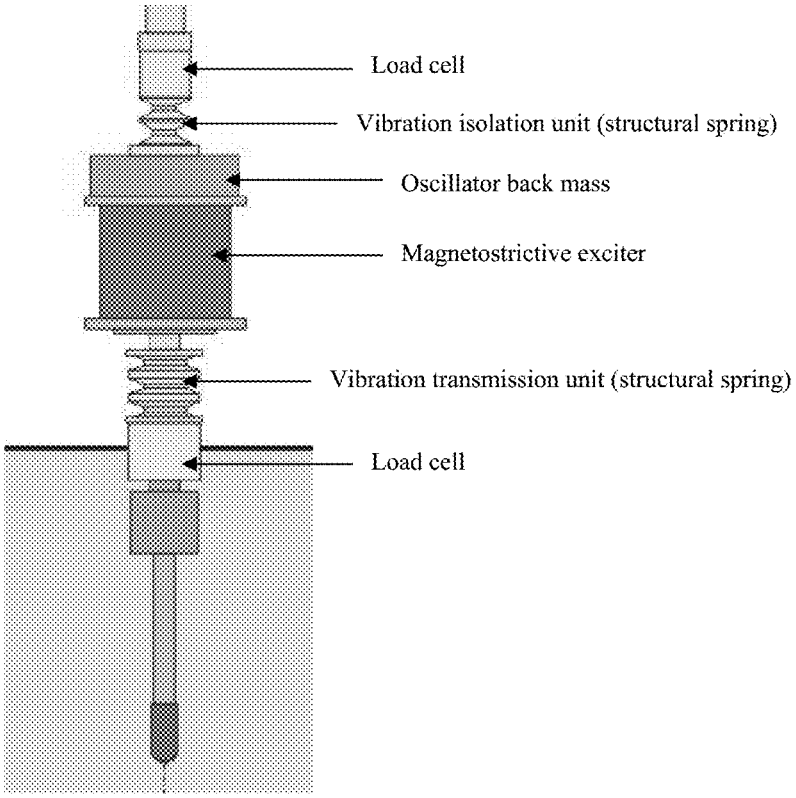
FIG. 1 depict a photograph and a schematic of the resonance enhanced drilling (RED) module according to the first embodiment (arrangement) of the invention.
Figure 2:
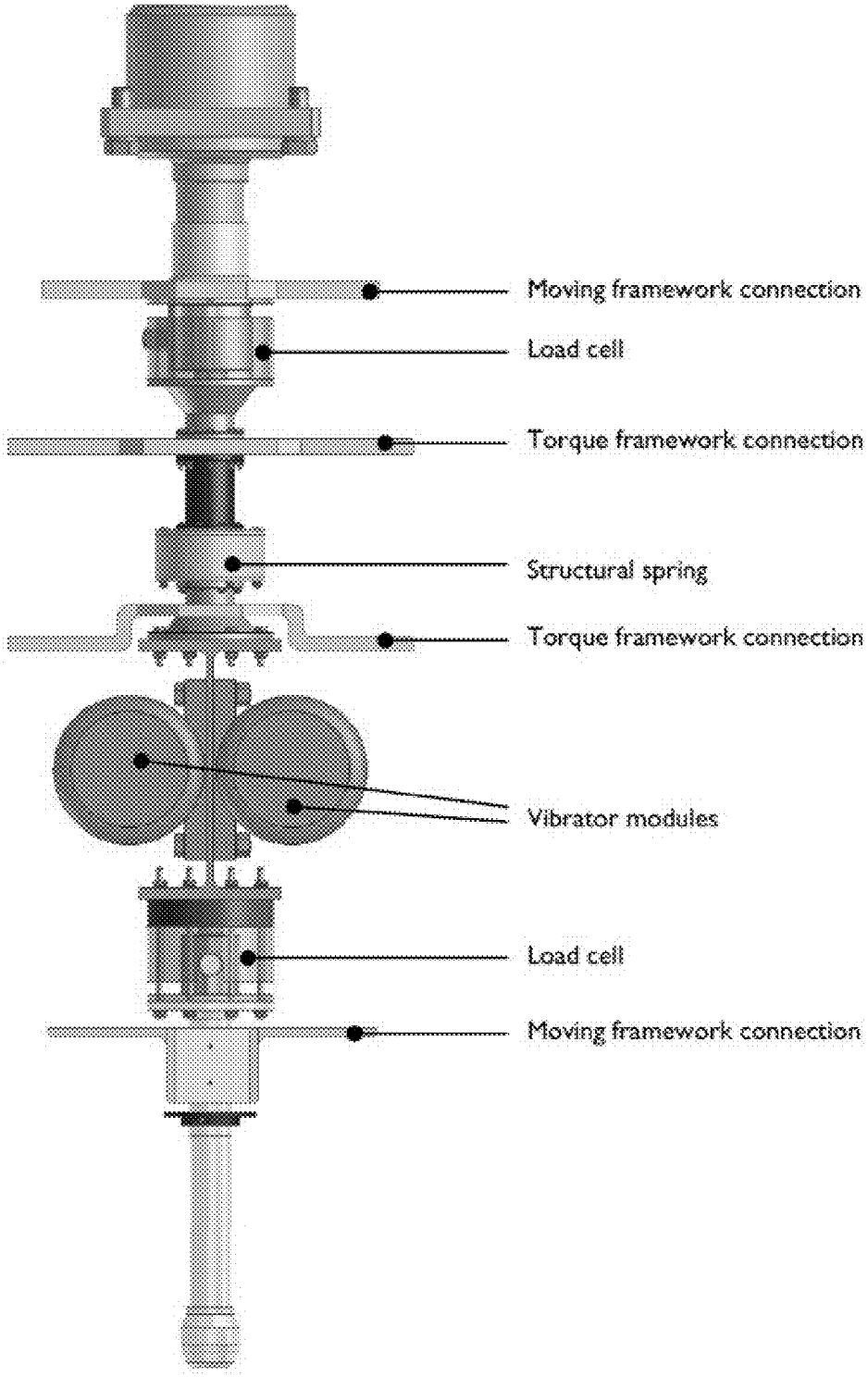
FIG. 2 depicts a schematic diagram of the apparatus according to the second embodiment (arrangement) of the invention.

A controller may be configured to perform the previously described method and incorporated into a resonance enhanced rotary drilling module such as those of the first and second embodiments of the invention, in FIGS. 1-2. The resonance enhanced rotary drilling module is provided with sensors (the load cells) which monitor the compressive strength of the material being drilled, either directly or indirectly, and provide signals to the controller which are representative of the compressive strength of the material being drilled. The controller is configured to receive the signals from the sensors and adjust the frequency (f) and the dynamic force ($F_d$) of the oscillator using a closed loop real-time feedback mechanism according to changes in the compressive strength ($U_s$) of the material being drilled.

The inventors have determined that, the best arrangement for providing feedback control is to locate all the sensing, processing and control elements of the feedback mechanism within a down hole assembly, as in the first and second embodiments. This arrangement is the most compact, provides faster feedback and a speedier response to changes in resonance conditions, and also allows drill heads to be manufactured with the necessary feedback control integrated therein such that the drill heads can be retro fitted to existing drill strings without requiring the whole of the drilling system to be replaced.

FIG. 7 shows a schematic diagram illustrating a downhole closed loop real-time feedback mechanism. One or more sensors 40 are provided to monitor the frequency and amplitude of an oscillator 42. A processor 44 is arranged to receive signals from the one or more sensors 40 and send one or more output signals to the controller 46 for controlling frequency and amplitude of the oscillator 42. A power source 48 is connected to the feedback loop. The power source 48 may be a mud motor or turbine configured to generate electricity for the feedback loop. In the figure, the power source is shown as being connected to the controller of the oscillator for providing variable power to the oscillator depending on the signals received from the processor. However, the power source could be connected to any one or more of the components in the feedback loop. Low power components such as the sensors and processor may have their own power supply in the form of a battery.

While this invention has been particularly shown and described with reference to preferred embodiments, it will be understood to those skilled in the art that various changes in form and detail may be made without departing from the scope of the invention as defined by the appending claims.

The invention claimed is:

1. An apparatus for use in resonance enhanced rotary drilling, which apparatus comprises:

(i) a load-cell for measuring static and dynamic axial loading;

(ii) a vibration isolation unit;

(iii) an oscillator comprising a dynamic exciter for applying axial oscillatory loading to the rotary drill-bit;

(iv) a vibration transmission unit for mechanically amplifying vibration;

(v) a load-cell for measuring static and dynamic axial loading;

(vi) a drill-bit connector; and (vii) a drill-bit, wherein the load-cell (i) is positioned above the vibration isolation unit and the load cell (vi) is positioned between the vibration transmission unit and the drill-bit, wherein the load-cells are connected to a controller in order to provide down-hole closed loop real time control of the oscillator, and wherein the vibration transmission unit comprises a structural spring.

2. An apparatus according to claim 1, wherein the dynamic exciter comprises a magnetostrictive exciter.

3. An apparatus according to claim 1, wherein the vibration isolation unit comprises a structural spring.

4. An apparatus according to claim 1, further comprising an oscillator back mass.

5. An apparatus for use in resonance enhanced rotary drilling, which apparatus comprises:

(i) a load-cell for measuring static loading;

(ii) a vibration isolation unit;

(iii) an oscillator for applying axial oscillatory loading to the rotary drill-bit;

(iv) a load-cell for measuring dynamic axial loading;

(v) a drill-bit connector; and (vi) a drill-bit, wherein the load-cell (i) is positioned above the vibration isolation unit, the vibration isolation unit is positioned above the oscillator, and the load cell (iv) is positioned between the oscillator and the drill-bit, wherein the load-cells are connected to a controller in order to provide down-hole closed loop real time control of the oscillator, and wherein the vibration isolation unit comprises a structural spring.

6. An apparatus according to claim 5, wherein the oscillator comprises an electrically driven mechanical actuator.

7. An apparatus according to claim 1 or 5, wherein the frequency (f) and the dynamic force ($F_d$) of the oscillator are capable of being controlled by the controller.

8. An apparatus according to claim 7, wherein the frequency (f) and the dynamic force ($F_d$) of the oscillator are capable of control according to load cell measurements representing changes in the compressive strength ($U_s$) of material being drilled.

9. An apparatus of claim 8, wherein the frequency (f) of the oscillator is controlled to be maintained in the range 100 Hz and above.

10. An apparatus of claim 8, wherein the dynamic force ($F_d$) is controlled to be maintained within the range up to 1000 kN.

11. A method of drilling comprising operating an apparatus as defined in any of claims 1 or 5.

12. A method according to claim 11, wherein the method further comprises controlling the amplitude of vibration of the oscillator to be maintained within the range 0.5 to 10 mm.

13. A method of claim 11, wherein the frequency (f) of the oscillator is controlled to be maintained in the range 100 Hz and above.

14. A method of claim 11, wherein the dynamic force ($F_d$) is controlled to be maintained within the range up to 1000 kN.

15. A method for controlling a resonance enhanced rotary drill comprising an apparatus as defined in claims 1 or 5, the method comprising:

controlling frequency (f) of the oscillator in the resonance enhanced rotary drill whereby the frequency (f) is maintained in the range:

$$(D^2U_s/(8000\pi Am))^{1/2} \leq f \leq S_f(D^2U_s/(8000\pi Am))^{1/2}$$

where D is diameter of the rotary drill-bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

16. A method according to claim 15, wherein $S_f$ is less than 5.

17. A method according to claim 15, wherein $S_{Fd}$ is less than 5.

18. A method according to claim 17, wherein $X > f_r/100$.

19. A method according to claim 15, wherein $S_f$ is selected whereby:

$$f \leq f_r$$

where $f_r$ is a frequency corresponding to peak resonance conditions for the material being drilled.

20. A method according to claim 19, wherein $S_f$ is selected whereby:

$$f \leq (f_r - X)$$

where X is a safety factor ensuring that the frequency (f) does not exceed that of peak resonance conditions at a transition between two different materials being drilled.

21. A method according to claim 20, wherein one or both of X and Y are adjustable according to predicted variations in the compressive strength ($U_s$) of the material being drilled and speed with which the frequency (f) and dynamic force ($F_d$) can be changed when a change in the compressive strength ($U_s$) of the material being drilled is detected.

22. A method according to claim 15, wherein:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled.

23. A method according to claim 22, wherein $Y > S_{Fd}[(\pi/4)D^2_{eff}U_s]/100$.

* * * * *